US008764248B1

(12) United States Patent
Simon

(10) Patent No.: US 8,764,248 B1
(45) Date of Patent: Jul. 1, 2014

(54) LED LIGHTING SYSTEMS COMPRISING MODULES AND COMPONENTS THAT PERFORM MULTIPLE OPERATIONAL FUNCTIONS

(71) Applicant: Jerome H. Simon, Newton, MA (US)

(72) Inventor: Jerome H. Simon, Newton, MA (US)

( * ) Notice: Subject to any disclaimer, the term of this patent is extended or adjusted under 35 U.S.C. 154(b) by 0 days.

(21) Appl. No.: 13/784,011

(22) Filed: Mar. 4, 2013

Related U.S. Application Data

(60) Provisional application No. 61/634,556, filed on Mar. 2, 2012.

(51) Int. Cl.

| | |
|---|---|
| ***F21S 6/00*** | (2006.01) |
| ***F21V 29/00*** | (2006.01) |
| ***F21S 8/00*** | (2006.01) |

(52) U.S. Cl.
USPC ..... 362/294; 362/257; 362/277; 362/285; 362/311.01

(58) Field of Classification Search
None
See application file for complete search history.

(56) References Cited

U.S. PATENT DOCUMENTS

| | | | | |
|---|---|---|---|---|
| 6,536,921 | B1 * | 3/2003 | Simon | 362/277 |
| 6,644,831 | B2 * | 11/2003 | Simon | 362/640 |
| 2002/0181239 | A1 * | 12/2002 | Simon | 362/429 |

* cited by examiner

*Primary Examiner* — Natalie Walford
(74) *Attorney, Agent, or Firm* — Burns & Levinson LLP; David W Gomes; Jerry Cohen

(57) ABSTRACT

An LED lighting system provides at least one LED illuminating module for use in light bulbs and luminaires.

13 Claims, 8 Drawing Sheets

LB

LED
C1
RF
C1
LB
TC
CS
CP
CP

LT
IS
HS
KS
SP
C2
IP
DP
AX

LED LIGHTING SYSTEMS COMPRISING MODULES AND COMPONENTS THAT PERFORM MULTIPLE OPERATIONAL FUNCTIONS

PREFERRED EMBODIMENTS

Figure 1:
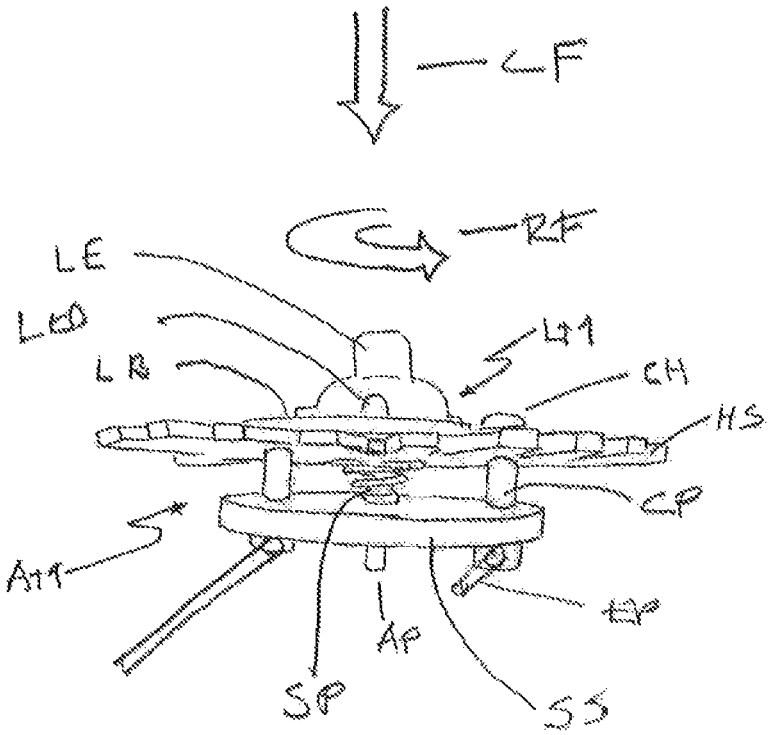
FIG. 1 is a three dimensional view of an LED illuminating module that can be used in light bulbs, luminaires and lighting systems.

FIG. 1 is a three dimensional view of one LED illuminating module LM of a modular lighting system that includes an electro/mechanical assembly AM including a compression component spring SP that simultaneously facilitates the functions of thermal transfer continuity between an LED LED (or clusters of LEDs) and a heat sink HS to which the LED LED is attached, electrical continuity between the LED LED and the electrical supply system EP, and a method for changing out (replacing) the LED LED within the light module LM. The thermal continuity function provided by compression spring component SP is disposed between and provides a compressive force between spring support component SS and heat sink HS, and by contact pin components CP one end of which are attached to spring support component SS and their other ends which have heads CH that hold firm the LED board LB to the heat sink HS—this detail is further described in FIG. 2. The LED changing replacement function is achieved by manually applying a compressive force (indicated by arrow CF) to the LED board LB (and or components firmly attached to the LED board LB such as optical elements lens LE) and by substantially and simultaneously rotating (indicated by arrow RF) the LED board so that the contact heads CH of the contact pins CP align with and can pass through the rotary key way slots disposed within the LED board LB (further described in FIG. 2), thus releasing the LED and LED/LED board LB combination from the LED module LM.

Figure 2:
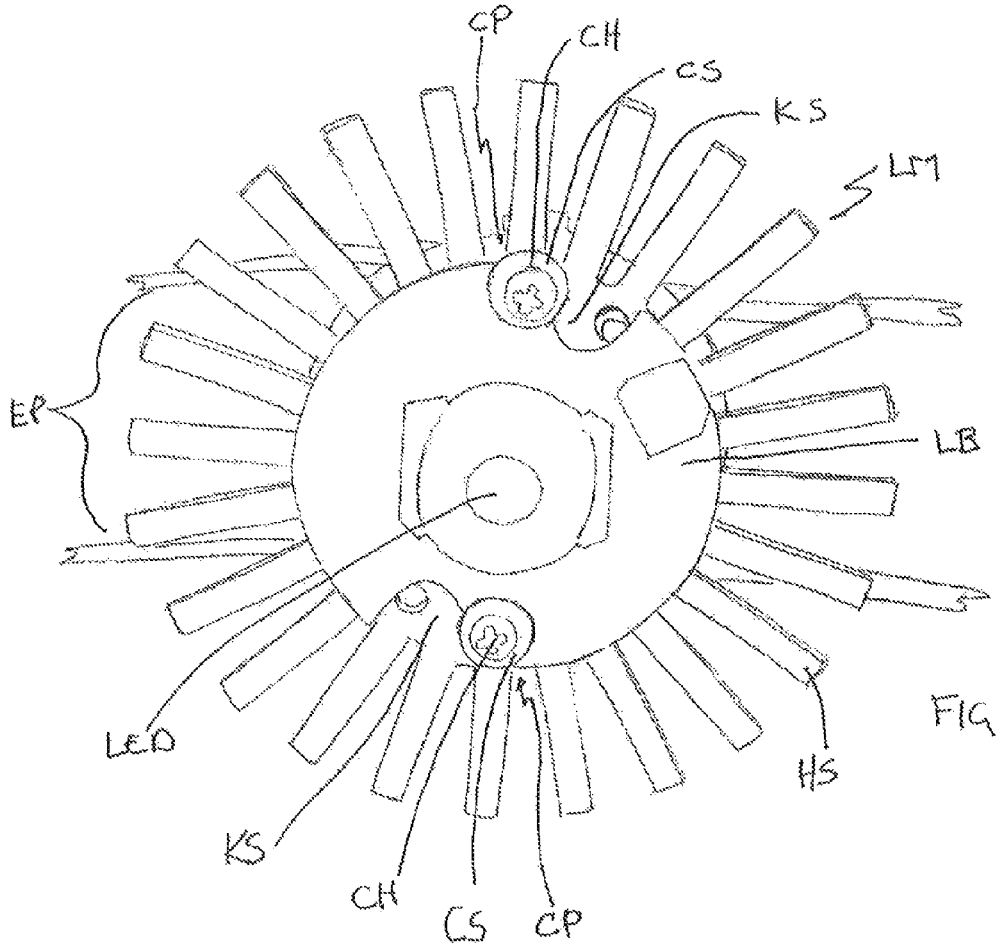
FIG. 2 is a plan view of the LED illuminating module illustrated in FIG. 1.

FIG. 2 is substantially a plan view of the LED illuminating module LM shown in FIG. 1 illustrating two key way slots KS each having a contact surface CS at least partially surrounding a narrow portion of the key way slots KS thru which each respective contact pins CP pass thru, the heads CH of the contact pins CP are held fast onto making contact with electrical contact surface CS and by creating tension against the compressive force created by spring SP (see FIG. 1), facilitating the thermal transfer between LED board LB and heat sink HS, while simultaneously providing electrical continuity between the electrical power system EP and the LED LED.

Figures 3, 3A:
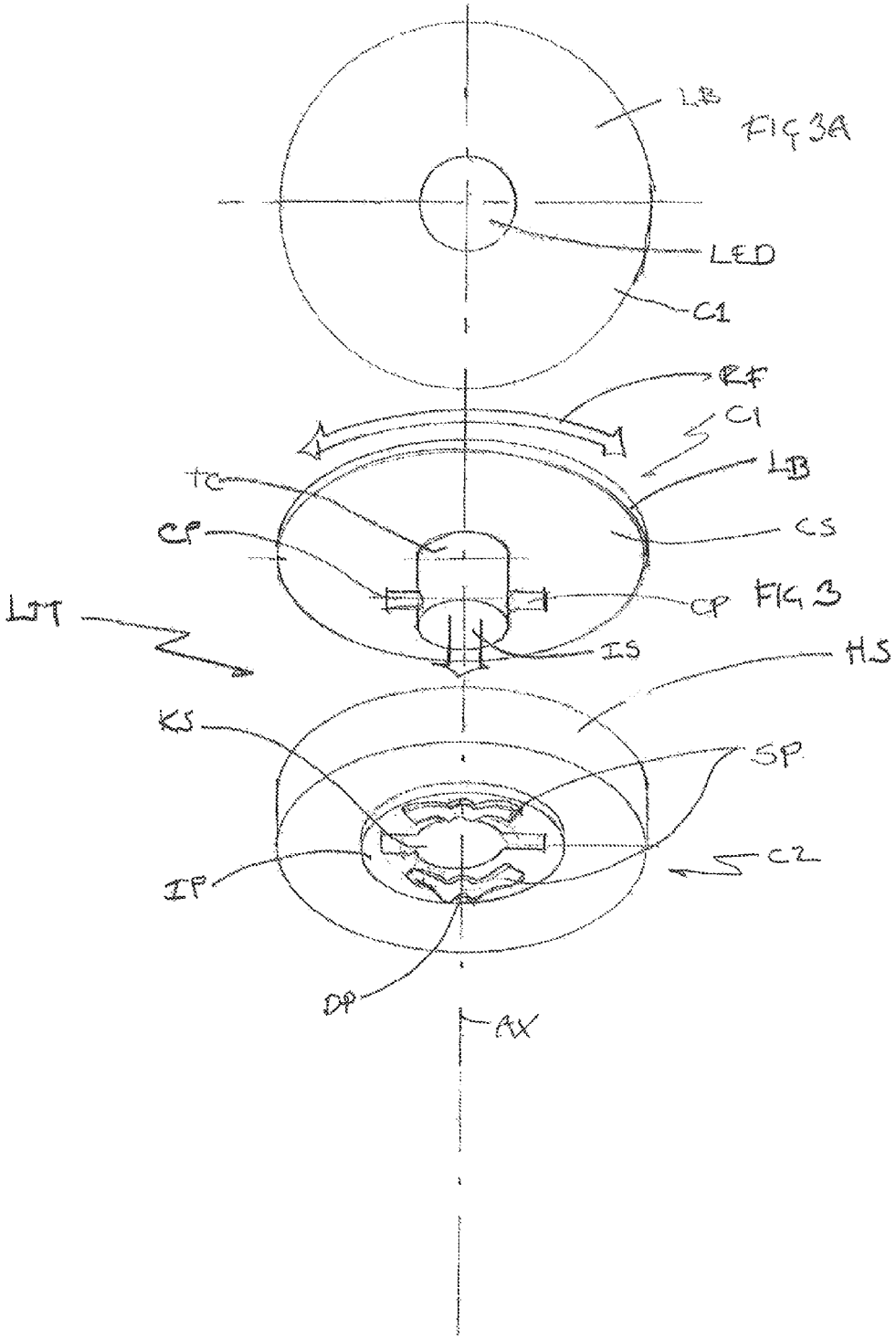
FIG. 3 is a three dimensional diagram of an LED illuminating module containing two assembled components.
FIG. 3A is a plan view of the LED illuminating module Illustrated in FIG. 3.

FIG. 3 is a three dimensional two component diagram of an LED illuminating module LM similar in function but differing in component configuration as that shown in FIGS. 1 and 2 in that the thermal continuity function and the compressive force between the contact surface CS of LED board LB and the heat sink HS is provided by a compressive force created between contact springs SP (which function similarly to leaf springs) and electrical contact pins CP when the $1^{st}$ component C1 and the $2^{nd}$ component C2 are assembled together. The assembly and the related thermal continuity is achieved by inserting (indicated by arrow IS) tension rod TC into and thru keyway slot KS, then by rotating (indicated by arrow RF) LED board LB about axis AX in relation to heat sink HS so that electrical contact springs SP create a compressive force between contact pins CP and heat sink HS drawing contact surface CS of LED board LB onto heat sink HS. Insulating washer IP is disposed between the contact spring(s) and heat sink HS to eliminate a potential short circuit. Depression(s) DP in contact spring(s) CP provide a stable position for contact pins CP and to keep the component C1 and C2 in alignment and from accidently rotating in respect to each other and detaching from one another. The function of electrical continuity is achieved (at least in part) thru the contact of the contact pins CP (which are electrically connected to the LED) and the contact springs SP (which are electrically conductive and connected to a power source).

FIG. 3A is a plan view of component C1 of the LED illuminating module LM described in FIG. 3 showing an LED LED or an LED array mounted to LED board LB.

Figure 4:
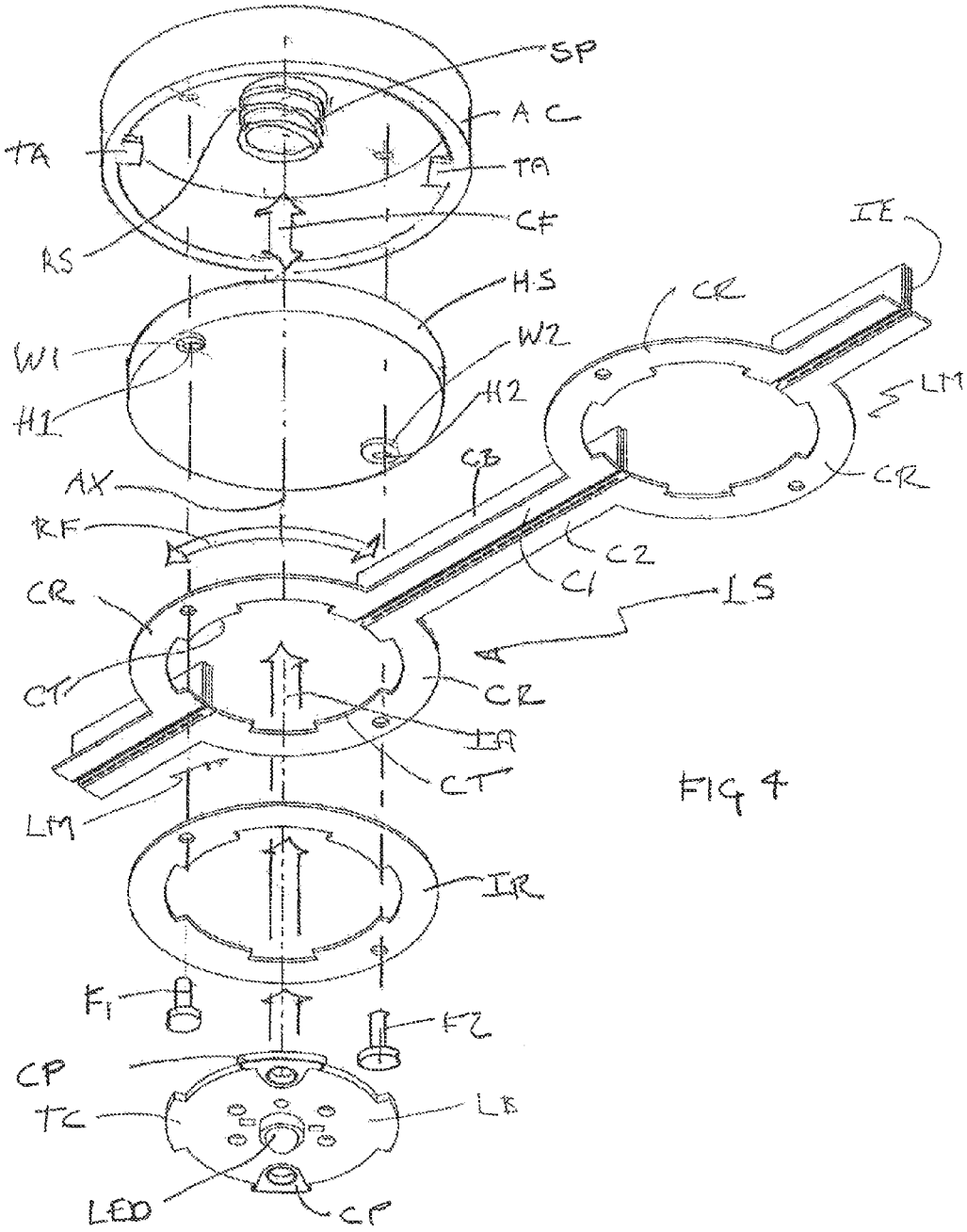
FIG. 4 is an exploded isometric view of an LED lighting system showing, in part, two LED illuminating modules.

FIG. 4 is an exploded isometric view of an illuminating module system LS illustrating (in part) two LED illuminating modules and their associated components. The operational functions of thermal transfer, electrical continuity, and LED replacement, and the combination of electro mechanical components that facilitate these functions are similar to those illustrated in FIGS. 1 thru 3A and are described as follows: when illuminating module LM is assembled, the components of which are stacked together and aligned about axis AX, heat sink HS is disposed within container assembly AC and retained by tabs TA (or by other mechanical means) so that the force exerted by compression spring SP (mounted to compression retaining surface RS of the assembly container AC) does not expel the heat sink HS out from assembly container AC while maintaining the compressive force (illustrated by arrow CF) between the compressive retaining surface RS of the assembly container AC and the heat sink HS. Further, insulating ring IR is attached to contact ring segments CR by insulating fasteners F1 and F2 which also pass thru insulating washers 1W and 2W then thru heat sink HS, attaching and aligning the above stated components to the assembly container AC. Another function of insulating fasteners F1 and F2 is to provide tension to maintain the distance and compressive force between the components and to facilitate proper functioning within the module. The diameters of the alignment holes H1 and H2 located in heat sink HS and insulating washers W1 and W2 surrounding holes H1 and H2 are larger than the diameter of the insulating fasteners F1 and F2 so that Heat sink HS can move freely along axis AX within assembly container AC. The thermal continuity function, electrical continuity function, and the LED change out replacement function are simultaneously achieved by inserting (indicated by axial arrow IA) LED board LB thru the insulating ring IR and thru the contact rings CR, then compressing compression spring SP by forcing LED board LB against and making thermal contact with heat sink HS, and then rotating (indicated by arrow RF) LED board LB so that its associated electrical contact points CP substantially located on protrusions TC rest on and make a compression contact with contact tabs CT of contact rings CR. Also shown in FIG. 4 is electrical connecting bridge CB provides both electrical continuity and structural integrity between at least two LED illuminating modules LM. In this embodiment electrical conducting bridge CB has two conducting elements C1 and C2 separated by an insulating element IE. In other embodiments the electrical conducting bridge can have one or another quantity of conductors.

Figure 5:
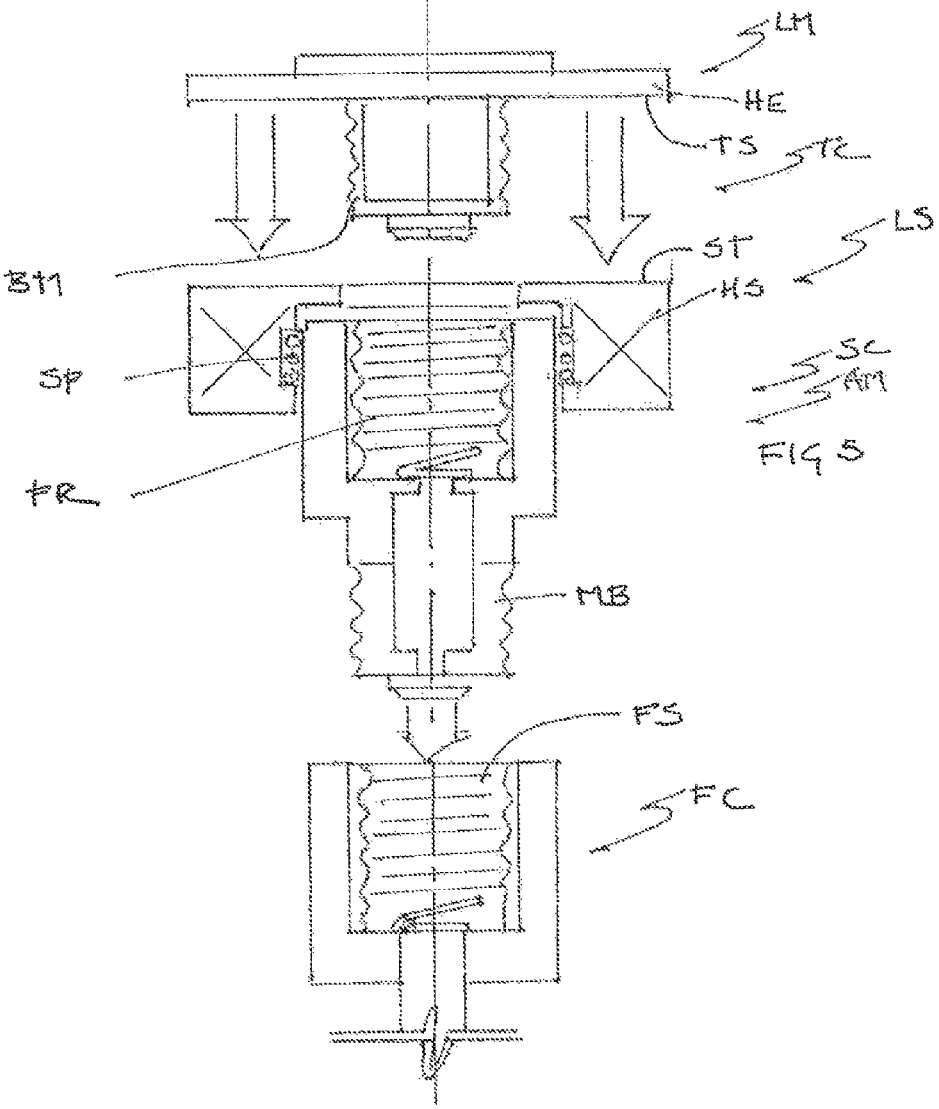
FIG. 5 is a side view sectional diagram of an LED lighting system having components that adapt the LED illuminating module for use in standard bulb sockets.

FIG. 5 is a side view sectional view diagram of a component lighting system LS consisting of a first component FC being a standard female bulb socket FS (receptacle), a second component SC being an adaptor module AM having a male base MB on one end of the component SC which mates the female bulb socket FS of the first component FC and a female receptacle FR on the other end the component SC, and a third component TC which is an LED illuminating module LM having a male base BM which mates with the female receptacle FR in the second component SC. The components that facilitate the functions of thermal connection, electrical continuity, and LED change out and replacement as described in FIGS. 1 thru 4 can be used as alternates to the mating male base and female receptacle that perform the above stated functions between the second (adaptor) component and the third (illuminating module) component.

The compressive force created by screwing the male base BM of the third component TC into the female receptacle FR of the second component SC, creates a contact between the thermal transfer surface TS of the heat transfer element HE of the third component TC, with the heat transfer surface ST of the heat sink HS of the second component SC. Spring element SP can be employed to supply uniform and constant pressure between the thermal transfer surface TS of the heat transfer element HE and the thermal transfer surface ST of the heat sink SH.

The second component SC being (same as) the adaptor module AM can be used to convert hard wired and cord and plug type fixtures for use with LED modules. Female socket FS of first component FC and associated male base MB of second component SC, and female receptacle FR of second component SC, and female receptacle FR of second component SC and associate male base BM of third component TC, can include among other socket types, medium base, mogul base, candelabra base, miniature base, single or double contact base, prefocused, and pin bases.

Figure 6:
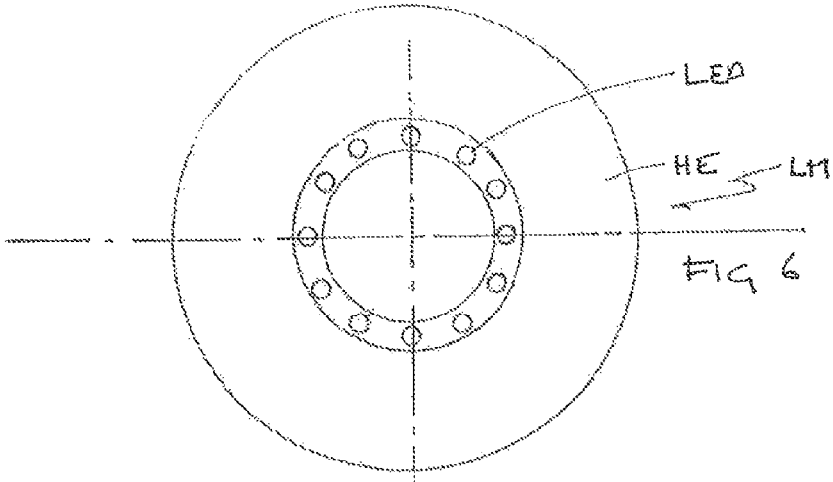
FIG. 6 is a plan view of the LED lighting system shown in FIG. 5.

FIG. 6 is a plan view of the third component TC, the LED illuminating module LM described in FIG. 5 showing a cluster of LEDs LED and heat transfer element HE.

Figure 7:
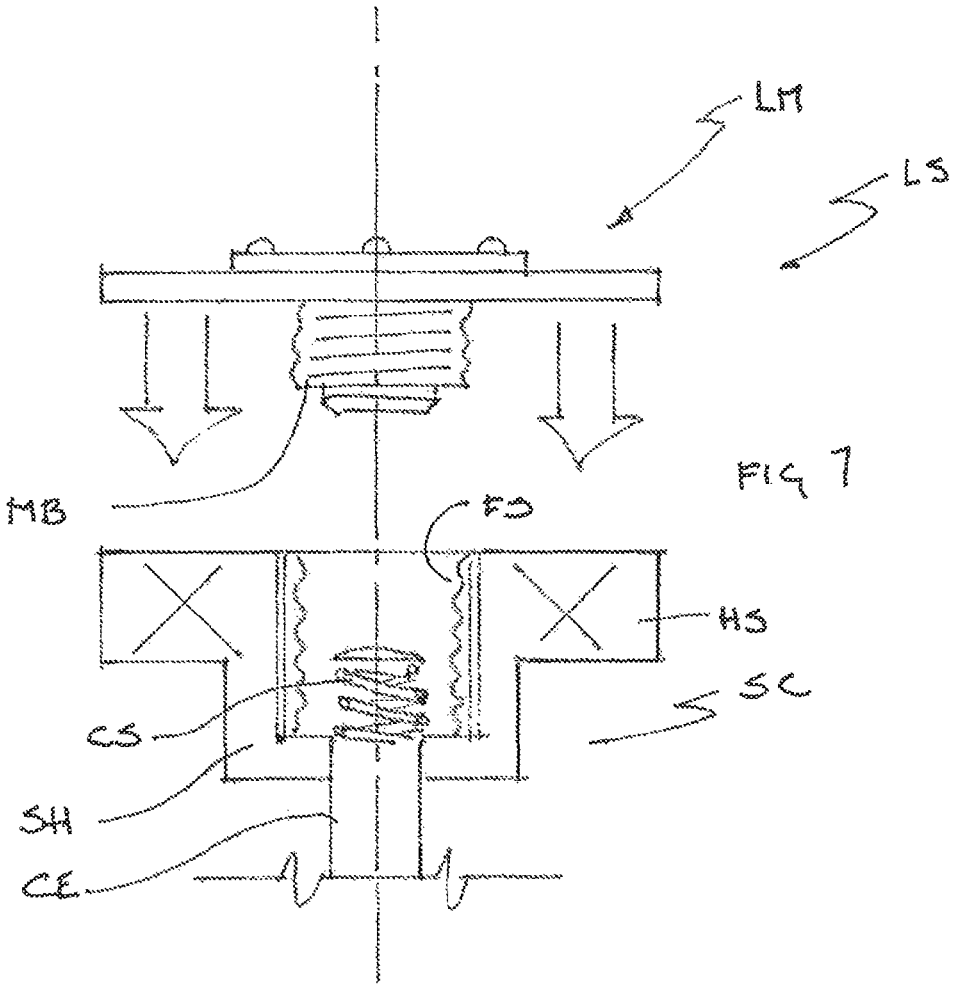
FIG. 7 is a side view sectional diagram of an LED lighting system having similar application characteristics to the illuminating Module Illustrated in FIG. 5.

FIG. 7 is a side view section of a component lighting system LS having similar characteristics and functions to the lighting system described in FIG. 5.

FIG. 7 differs from FIG. 5 in that lighting system LS in FIG. 7 contains only 2 components, a socket component SC and a light module component LM. Socket component SC contains a female socket FS (in this embodiment a screw type socket) located within a socket housing SH, an electrical contact spring CS located within the female socket FS, a connecting element CE that connects the socket component SC to a lumenair, and a heat sink HS directly attached to the socket housing SH. The light module component LM contains clusters of LEDs LED mounted to a heat transfer element HE, and a male screw base MB that screws into female socket FS so as to perform the functions of thermal connection of the heat transfer element HE of the light module LM to the heat sink HS, and the function of electrical continuity between components SC and LM, and the function of changing the LEDs. All three of the above functions are also described in FIG. 5. The contact spring CS is extended so as to make contact with the male screw base MB which (in this embodiment) is shortened so as to not make unwanted electrical contact within a general usage female socket. The component system in FIG. 7 differs in function to the component system as in FIG. 5 in that the heat transfer between the light module component LM and the socket component SC is achieved without an intervening adaptor which is component SC as shown in FIG. 5.

Figure 8:
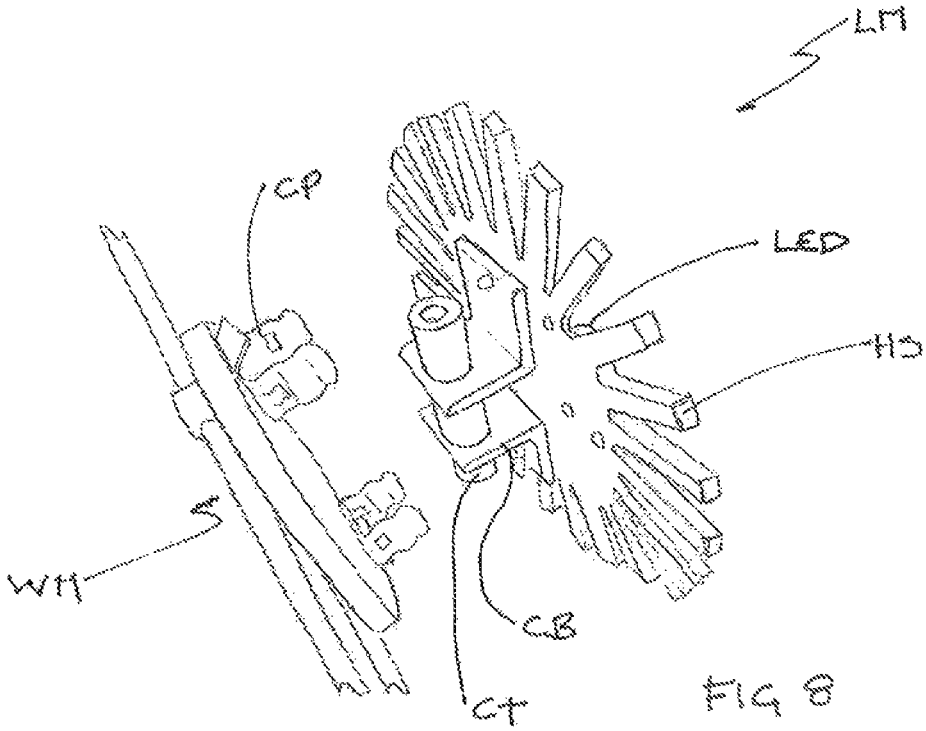
FIG. 8 is a three dimensional view of an LED illuminating module that employs clips and terminals to facilitate replacement of the LEDS and maintain electrical continuity between the LED and a source of power.

FIG. 8 is a three dimensional view of an LED module LM that employs female clips CP and male terminals CT to facilitate change out (placement and replacement) of the LEDS LED and maintain electrical continuity between the LEDs LED and a power source, provided through a wiring module WM. LED Module LM contains a heat sink HS onto which the LED LED is mounted. The male clip terminals CT can be considered part of the wiring module WM or part of the LED module LM. The male clip terminals CT (in this embodiment) are connected to the heat sink HS by brackets CB. The LED module can be similar in form and function to those illustrated and described in pending and provisional application Ser. Nos. 61/520,585; 61/752,440; 61/574,988; 61/627,620; 61/571,020; 61/630,119; Application No. 61/284,059, which are incorporated herein by reference.

Figure 9:
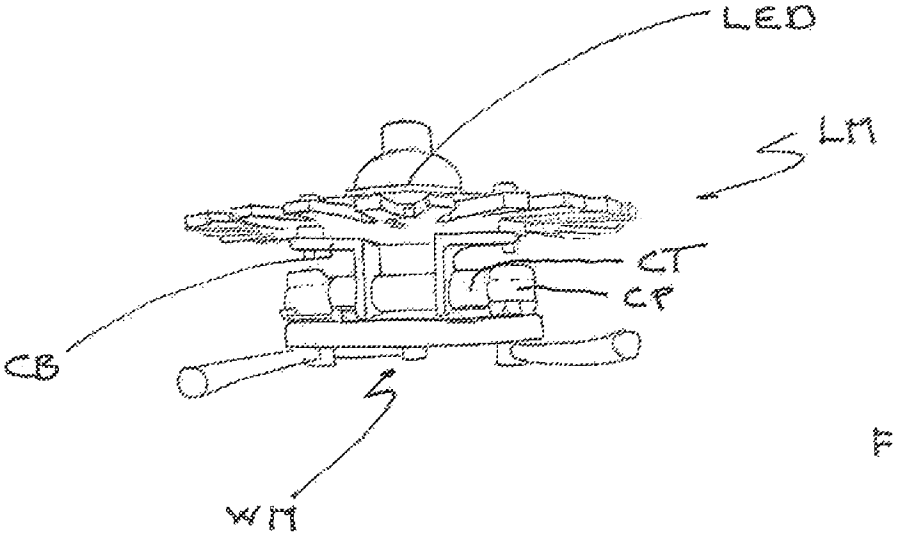
FIG. 9 is a three dimensional view of the LED fighting module as that shown in FIG. 8 taken at a different angle.

FIG. 9 is a three dimensional view of the lighting module LM as described in FIG. 8 taken at a different angle, illustrating male clips CT engaged with (snapped into) female clips CP.

What is claimed is:

1. An LED lighting system having at least one LED illuminating module for use in light bulbs and luminaires comprising:

An assembly of lighting components, thermal transfer components and electrical components that provide for the combined functions of thermal transfer between an LED and a related heat sink, electrical continuity from a power source to the LED, and the mechanism to change and replace the LED containing:

at least one LED mounted to an LED board, said LED board having a heat transfer surface and at least one electrical contact a heat sink onto which the LED board is thermally connected, electrically conductive components to provide electrical continuity between the LED and an electrical power source, an electro/mechanical component system assembly comprising at least one compression component(s) providing a compressive force and physical contact and therefore facilitating the thermal transfer function between the LED board and the heat sink while simultaneously facilitating an electrical connection continuity to the LED, and also providing the function of placement and replacement of the LED, and at least one tension component so constructed as to maintain the compressive force and therefore maintain the above stated thermal and electrical connections, and mechanical joining components onto and by which the compression, tension and electrical contacts are connected.

2. An LED lighting system as in claim 1 wherein the component for creating compression is a spring.

3. An LED lighting system as in claim 2 wherein the component for creating compression is coiled spring.

4. An LED lighting system as in claim 1 wherein the tension component is at least in part fabricated from conductive material.

5. An LED lighting system as in claim 2 wherein the spring component is made from an electrically conductive material which makes contact with an electrical contact component that is integrated with the tension component.

6. An LED lighting system as in claim 1 wherein the LED board has key way slots having wide and narrow portions and the tension members are bars having heads which can pass thru the wide portion of the key way slots, so by rotating the LED boards in relationship to the mechanical assembly the LED board can be released from or be re-attached to the LED illuminating module.

7. An LED lighting system as in claim 1 wherein there are at least two illuminating modules each connected by a bridge of electrically conductive material.

8. An LED lighting system as in claim 7 wherein the electrically conductive bridge is structural maintaining aligned disposition between the illuminating modules.

9. An LED lighting system as in claim 8 wherein the conductive bridge has electrical contacts and is fabricated from a continuous portion of material spanning and supplying electrical power to at least two illuminating modules.

10. An LED illuminating module as in claim 1 wherein the compression component comprises male and female threaded portions.

11. An illuminating module as in claim 1 wherein the illuminating module is in the form of a light bulb.

12. An LED lighting system for use in light bulbs and luminaires comprising:

a first component which is a standard female receptacle, a second component having a male base on one end of the component that mates and connects to the female receptacle of the first component, an electro/mechanical connecting device on the other end of the second component that mates with an electro/mechanical connecting device within, a third component being an LED illuminating module, the electro/mechanical device of the second component and the electro mechanical device of the third component so devised as to facilitate the functions of thermal transfer, electrical continuity, and change out (placement and replacement) of the LED module from the lighting system.

13. An LED lighting system for use in light bulbs and luminaires comprising:

An LED module having an LED thermally mounted to a heat sink, the LED modules having male clip terminals that are electrically connected to the LED, A wiring module having female mounting clips that are electrically connected to a wiring system, The connection of the clip terminals to the female mounting clips facilitates the functions of securing and removing of the LED and its related heat sink to and from the wiring module, and maintaining electrical continuity from a power source to the LED.

* * * * *